US009764337B2

(12) United States Patent
Westendarp et al.

(10) Patent No.: US 9,764,337 B2
(45) Date of Patent: Sep. 19, 2017

(54) DISCONTINUOUS CENTRIFUGE WITH A SCRAPER FOR SCRAPING A PRODUCT

(71) Applicants: Hans-Heinrich Westendarp, Braunschweig (DE); Dirk Spangenberg, Badersleben (DE)

(72) Inventors: Hans-Heinrich Westendarp, Braunschweig (DE); Dirk Spangenberg, Badersleben (DE)

(73) Assignee: BMA Braunschweigische Maschinenbauanstalt AG, Braunschweig (DE)

( * ) Notice: Subject to any disclaimer, the term of this patent is extended or adjusted under 35 U.S.C. 154(b) by 0 days.

(21) Appl. No.: 14/236,102

(22) PCT Filed: Nov. 20, 2012

(86) PCT No.: PCT/EP2012/073092
§ 371 (c)(1),
(2) Date: Jan. 30, 2014

(87) PCT Pub. No.: WO2013/076074
PCT Pub. Date: May 30, 2013

(65) Prior Publication Data

US 2014/0256528 A1 Sep. 11, 2014

(30) Foreign Application Priority Data

Nov. 24, 2011 (DE) ..... 10 2011 119 265

(51) Int. Cl.
*B04B 11/05* (2006.01)
*B04B 11/08* (2006.01)
(Continued)

(52) U.S. Cl.
CPC ..... *B04B 11/04* (2013.01); *B04B 3/00* (2013.01); *B04B 9/12* (2013.01); *B04B 11/05* (2013.01); *B04B 11/08* (2013.01)

(58) Field of Classification Search
CPC ..... B04B 11/04; B04B 11/05; B04B 11/08; B04B 9/12; B04B 3/00
(Continued)

(56) References Cited

U.S. PATENT DOCUMENTS 1,596,322 A 8/1926 Steps
2,083,899 A * 6/1937 Duerig ..... B04B 1/00 494/11
(Continued)

FOREIGN PATENT DOCUMENTS

BR MU 8800278-0 U 10/2008
CA 2849777 C * 11/2016 ..... B04B 3/00
(Continued)

*Primary Examiner* — Charles Cooley
(74) *Attorney, Agent, or Firm* — Salter & Michaelson

(57) ABSTRACT

A discontinuous centrifuge consists of a rotatable centrifuge drum incorporating a drive spindle, a casing and a base. A hub of the centrifuge drum comprises a plurality of arms for the indirect or direct connection of the casing of the centrifuge drum to the drive spindle of the centrifuge drum. A scraper serves for scraping a product off the inner wall of the casing of the rotatable centrifuge drum. The scraper comprises an element which is pivotal about an axis, which axis extends in parallel with the axis of rotation of the centrifuge drum. The element comprises a blade which extends over almost the entire height of the centrifuge drum and makes contact with the product after the pivotal movement. The scraper is not moveable vertically. The arms of the hub have upper surfaces which are located below the drum base. The scraper is mounted independently of the swinging suspension of the centrifuge drum.

13 Claims, 5 Drawing Sheets

(51) Int. Cl.
*B04B 11/04* (2006.01)
*B04B 3/00* (2006.01)
*B04B 9/12* (2006.01)

(58) Field of Classification Search
USPC ..... 494/58, 46
See application file for complete search history.

(56) References Cited

U.S. PATENT DOCUMENTS 2,953,250 A * 9/1960 Hilding ..... B04B 11/08 15/246.5
3,294,317 A * 12/1966 Francesco ..... B04B 11/05 210/147
3,446,431 A * 5/1969 Marchal ..... B04B 11/043 210/106
3,519,199 A * 7/1970 Todd ..... B04B 5/06 494/22
3,537,591 A * 11/1970 Hoks ..... B04B 3/00 210/374
3,664,151 A * 5/1972 Pause ..... B04B 9/12 210/366
5,252,202 A 10/1993 Hirose
5,328,441 A * 7/1994 Carr ..... B04B 11/05 210/372
2006/0207926 A1* 9/2006 Bartsch ..... B04B 3/00 210/360.1
2012/0122650 A1* 5/2012 Bartsch ..... B04B 9/12 494/82
2012/0142513 A1* 6/2012 Bartsch ..... B04B 3/00 494/26
2012/0329630 A1* 12/2012 Hoffmann ..... B04B 3/00 494/36
2014/0256528 A1* 9/2014 Westendarp ..... B04B 9/12 494/58
2014/0256529 A1* 9/2014 Westendarp ..... B04B 3/00 494/60
2015/0290662 A1* 10/2015 Lehnberger ..... B04B 7/02 494/2

FOREIGN PATENT DOCUMENTS

CN 201482579 5/2010
CN 101966493 2/2011
CN 201848316 6/2011
CN 102179316 9/2011
DE 1812030 A1 * 7/1969 ..... B04B 3/00
DE 1915980 A1 * 1/1970 ..... B04B 1/04
DE 3614965 11/1987
DE 10 2009 039 729 3/2011
EP 0 953 380 11/1999
EP 1 954 397 8/2008
FR 2 683 812 5/1993
GB 853 337 11/1960
GB 1 081 679 8/1967
JP FR 2683812 A1 * 5/1993 ..... B01D 21/00

* cited by examiner

DISCONTINUOUS CENTRIFUGE WITH A SCRAPER FOR SCRAPING A PRODUCT

FIELD AND BACKGROUND OF THE INVENTION

The invention relates to a discontinuous centrifuge comprising a rotatable centrifuge drum incorporating a drive spindle, a casing and a base, a hub of the centrifuge drum which hub has a plurality of arms for the indirect or direct connection of the casing of the centrifuge drum to the drive spindle of the centrifuge drum, a scraper for scraping a product off the inner wall of the casing of the rotatable centrifuge drum at a scraper rotational speed, wherein the scraper comprises an element which is pivotal about an axis, which axis extends in parallel with the axis of rotation of the centrifuge drum, wherein the element comprises a blade which extends over almost the entire height of the centrifuge drum and makes contact with the product after the pivotal movement.

Discontinuous centrifuges are also used especially for the separation of sugar crystals from sugar crystal suspensions.

A starting material, a magma with enriched crystal suspensions for example, is supplied from above and is then treated in the centrifuge drum in such a way that a product, here for example a crystallised mass, is deposited on the inner surface of a casing of the centrifuge drum. The syrup passes out through a working filter which is located on the casing.

This crystallised mass or these crystal layers then have to be scraped out of the centrifuge drum so that it is ready for the next input or the next charge.

From DE 36 14 965 A1, there is known a centrifuge drum for a discontinuously operating flat bottom centrifuge. The drum base is fastened to a drum casing. The flat bottom of the drum falls away partially towards the hub of the centrifuge in order to enable the crystallised mass to discharge through openings in the base.

A discontinuous centrifuge such as the one described in EP 0 953 380 B1 has proved to be very well-suited for the scraping process. The crystal layers are removed from the inner surface of the casing of the centrifuge drum by means of a scraper which extends over the entire height of the centrifuge drum and can be swung about an axis parallel to the centrifuge drum in such a way that a blade thereof enters the sugar layers (or layers of another product) on the inner surface of the casing and gradually peels the crystallised mass off the casing in this way.

The crystal layers that have been peeled in this way then fall downwardly within the centrifuge drum onto the base thereof due to the force of gravity and are then removed therefrom through a central opening therein.

It should be taken into consideration thereby that in the lower region of the centrifuge drum there is a hub having a plurality of arms which connects the casing of the centrifuge via the base to a shaft or drive spindle which provides the drive means for the rotation of the centrifuge drum and runs in the axle of the centrifuge drum.

In order to enable the substantial forces to be transferred from this spindle to the centrifuge drum rotating at high-speed or via the base to the casing, this hub is reinforced and strengthened three-dimensionally by means of built-in features, inclined arms and further elements.

Since the scraper and the blade or peeling knife thereof and the elements of the hub and the arms thereof would mutually interfere, the scraper is moved upwardly parallel to the axis by about 200 mm during the centrifuging process.

Before the peeling process, the scraper then travels vertically or parallel to the axis back towards the bottom of the centrifuge drum to its lowest point and it is only then that it is pivoted about the pivotal axis into the sugar layers.

From DE 10 2009 039 729 A1, there is known a centrifuge for a completely different purpose. There, a shaver/knife device is proposed as a scraper for a centrifuge that is mounted in pendulum-like manner for the purposes of stripping-off caked-on material. A plurality of shavers are mounted on an arm which extends in parallel with the shaft of the centrifuge drum and engage in knives that protrude from the cylinder wall. Moreover, an inner housing is provided. The entire conception is not suitable for sugar centrifuges.

From BR-MU 8800278-0 U, a proposal is known for additionally safeguarding this vertical travel of a scraper by means of a locking device so as to ensure that the pivotal process will only occur when the scraper is in the correct position. Moreover, it is also proposed that the length of the lowering stroke should be as small as possible.

Such an additional locking device increases the overall expenditure by quite a considerable amount. Apart from the additional costs, there is also the corresponding factor of the time that is necessary for the locking process and also for the process of unlocking this locking device in due course. Moreover, it relates to a device under load which entails additional wear and tear and also the danger of malfunctioning.

In a further proposal for a discontinuous centrifuge of this type that is known from EP 1 954 397 B1, it is proposed that two separate spade-like scrapers located one above the other be used rather than one scraper spanning the entire length of the centrifuge drum in the axial direction. In addition, the two partial scrapers are to be displaced from one another and should respectively scrape off an upper and a lower part of the centrifuge drum in a very complicated manner relative to each other. At the same time, the vertical stroke in the axial direction of the centrifuge drum for the two spade-like scrapers should be independently controllable and should also be restricted.

This conception is extraordinarily costly and requires an extremely complex arrangement in order to ensure the separate movement and control of the two spade-like scrapers.

The users of such discontinuous centrifuges are however interested in an operational mode of the centrifuge drum which is as smooth as possible and is least prone to errors. The layout on equipment should be as low as possible and the number of relatively moving parts as few as possible.

Moreover, it would be desirable if there were to be as little loss of time as possible from the real working time due to ineffective safeguards and the like.

Consequently, the object of the invention is to propose a discontinuous centrifuge which is capable of carrying out a scraping process on the inner wall of a casing of a centrifuge drum with reduced layout on equipment.

SUMMARY OF THE INVENTION

This object is achieved in the case of a discontinuous centrifuge drum in accordance with the preamble of the main Claim by means of the invention in that the arms of the hub comprise upper surfaces which are located below the drum base.

Surprisingly, a configuration of this type results in a substantially improved discontinuous centrifuge and in particular a discontinuous sugar centrifuge.

The discontinuous centrifuge in accordance with the invention actually has the substantial advantage that the scraper no longer has to be designed for movement in the vertical direction. A drive means for moving the scraper in the vertical direction is no longer necessary. It merely needs to be capable of carrying out a pivotal movement.

The scraper no longer has to be partially lifted out of the drum in order to avoid collisions and obstructions. This means that ineffective idle time of any kind which until now has increased the duration of the charging process and thus lowered the effectiveness of the machines is no longer applicable.

Surprisingly, this becomes possible in that the provision of built-in features and bracing struts in the lower region of a centrifuge drum is avoided. The reinforcements that were present there until now are shifted into the region below the base of the centrifuge drum.

This had not been considered possible until now. However as experiments have shown, this can be done by skilful location of the arms of a hub, namely, in the particular case where the upper surfaces of these arms are located below the base.

Anyhow, this can work with just a single scraper without any complicated, expensive and damage-prone splitting of the scraper into a plurality of individual parts.

Consequently, the geometry of the scraper plough, the position of the scraper plough and the implementation of the connection of the centrifuge drum to the drum axle are changed in such a way that the scraper plough or the peeling knife can remain in the drum during the entire charging process.

The design of the drum hub is particularly expedient if it consists of three arms. In this case in particular, the ratio of the opening surface relative to the mechanical reinforcement elements of the centrifuge drum is also optimal.

The opening surface can be closed by means of a closure device.

Furthermore, the disk is preferably not constructed in one piece manner, but is divided into segments in such a manner that the segments fill out the free space between the arms of the hub and permit free movement of the segments relative to the arms.

Moreover, it is of especial advantage if use is made of a centrifuge concept which is suspended and creates a pendulum effect. Discontinuous centrifuges of this type are also referred to as suspended pendulum centrifuges.

Amongst other things, they are characterised by the fact that the scraper is moveable relative to the centrifuge drum and to the casing since it is not suspended therewith or at least is not part of the same suspension mechanism.

In these cases too, due to the invention, there is no interference between the scraper incorporating its scraper bar and its scraper plough or peeling knife and the centrifuge drum incorporating the casing, base and the hub thereof on the other hand.

Moreover, it is of special advantage that the construction of the scraper in accordance with the invention can accommodate particularly large forces. This is of particular advantage, because in this way it is possible to let the blade of the scraper enter the sugar layer in opposition to the direction of rotation of the drum in problem-free manner. High torques are thereby attainable.

Further preferred features of the invention are mentioned in the appendant Claims and in the following description of the Figures.

DESCRIPTION OF THE DRAWINGS

An exemplary embodiment of the invention is described in more detail hereinafter with the aid of the drawings. Therein.

DETAILED DESCRIPTION

Figure 1:
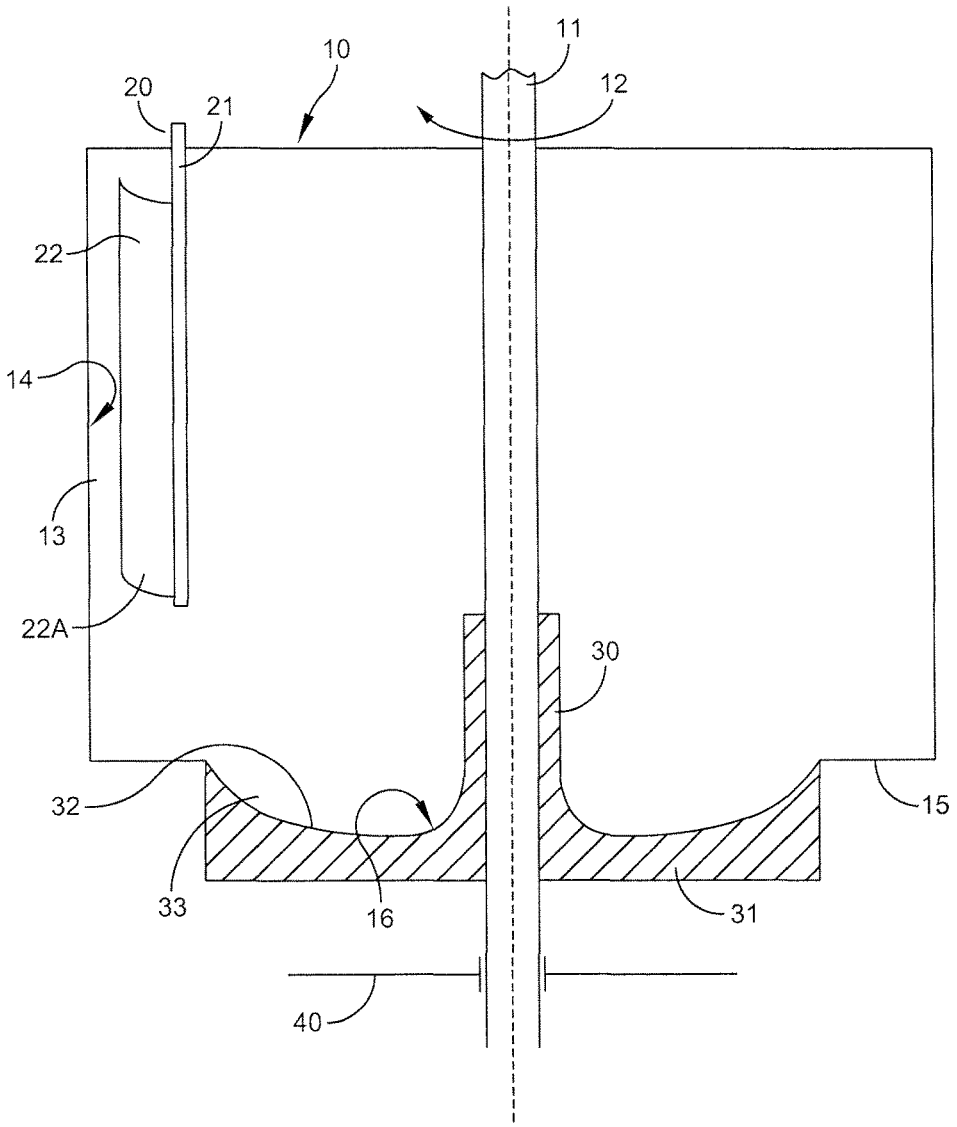
FIG. 1 shows a schematic sectional view of a discontinuous centrifuge in one embodiment of the invention.

In the schematic illustration in FIG. 1, one sees a vertical central section of a centrifuge, such as a sugar centrifuge, having a centrifuge drum 10. The centrifuge drum 10 has a drive spindle 11 which also forms the vertically disposed axis of the centrifuge drum 10 and provides the rotary drive for the entire centrifuge drum 10. The drive spindle 11 is only indicated schematically in FIG. 1. The direction of rotation 12 is additionally marked by an arrow.

Furthermore, the centrifuge drum 10 comprises a casing 13 which is set into rotary motion by the rotary drive 11. The casing 13 is substantially cylindrical and the inner wall thereof is covered by a working screen which is not illustrated in detail.

A magma comprising, in particular, sugar crystals together with the mother syrup is loaded into the centrifuge drum 10. This magma is spun off by the centrifuge drum 10 which is driven at high-speed whereby the sugar crystals do not penetrate the working screen whereas the syrup passes through the working screen and passed out to the exterior through not illustrated holes in the casing 13.

After further working steps such as washing the crystals that have been deposited in this manner with a pure liquid for example, the sugar crystals remain clinging to the inside of the casing 13 in the form of a crystallised mass 14 and form a sort of sugar layer thereon.

The centrifuge drum 10 is closed at the bottom by a base 15. The base 15 is arranged to be substantially perpendicular to the axis of the centrifuge drum 10. However, the base 15 comprises openings 16 through which the crystallised mass 14 can escape from the centrifuge drum 10 under the force of gravity. These openings 16 are closed during the centrifuging process and are only opened thereafter.

A scraper 20 is provided in order to enable the crystallised mass 14 adhering to the inner wall of the casing 13 to be removed therefrom. The scraper 20 comprises a scraper bar 21 and an element 22 such as a peeling knife 22 or a scraper plough for example is arranged on the scraper bar 21 and including a lower end 22A. The peeling knife 22 or the scraper plough are pivotal relative to the scraper bar about the axis formed by the scraper bar 21.

The peeling knife 22 or the scraper plough run parallel to the axis of the centrifuge drum 10 and thus vertically. They extend over the whole or almost the whole height of the casing 13.

This pivotal movement causes the peeling knife 22 to enter into the crystallised mass 14. During the peeling process, the centrifuge drum 10 rotates at the rotational speed of the scraper. This rotational speed of the scraper is significantly lower than the rotational speed of the centrifuge drum 10 during the centrifuging process. Consequently, the swinging action of the element 22 or peeling knife causes the element 22 to gradually peel off the layers of the crystallised mass 14.

After the peeling process, the sugar crystals of the crystallised mass 14 fall downwardly within the centrifuge drum 11 under the force of gravity in the direction of the base 15 and from there they pass through the openings 16 which are now no longer closed.

The connection of the drive spindle 11 to the casing 13 is effected by a hub 30. In connection therewith, in the illustrated embodiment, the hub is connected to an outer region of the base 15 which, for its part, adjoins the casing 13 and is connected thereto. Thus here, the base 15 serves for the onward transmission of the driving force which is conveyed thereto by the hub 30. In the illustrated exemplary embodiment, the hub 30 encloses the drive spindle 11 and has a plurality of arms 31.

There are free spaces (not visible in FIG. 1) between the arms 31 through which the sugar crystals of the crystallised mass 14 can also fall downwardly after passing through the openings 16 in the base 15.

In contrast to EP 0 953 380 B1, BR-MU 8800278-U and EP 1 954 397 B1, one can see that the arms 31 of the hub 30 run entirely below the base 15. The hub 30 protrudes upwardly through the base 15 into the interior of the centrifuge drum 10 only at the point of attachment thereof to the drive spindle 11.

The upper surfaces 32 of the arms 31 are formed in such a way that they comprise a set-back region 33.

Insofar, the sectional view in FIG. 1 does not show the section in a technically precise manner as, in the case of a preferred embodiment comprising three arms 31, a symmetrical arrangement of two arms 31 would not be seen in the sectional view. The illustration is effected here in order to enable the core of the invention to be schematically illustrated in a more meaningful manner.

Figure 2:
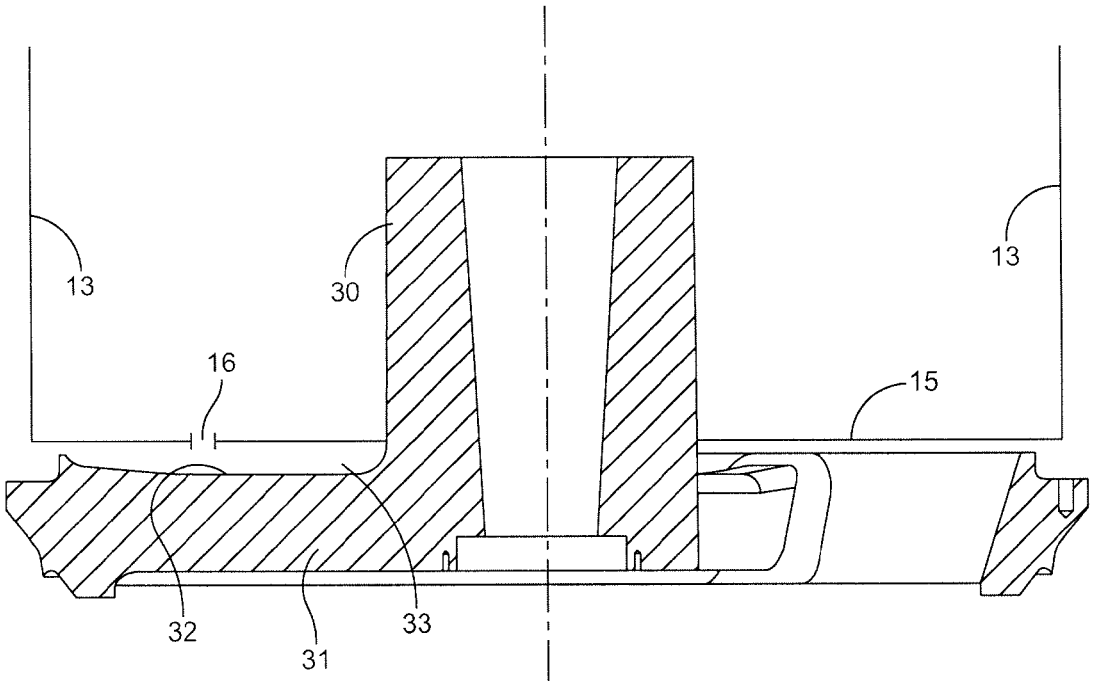
FIG. 2 an enlarged illustration of the region of a hub of the centrifuge depicted in FIG. 1.

One can see an enlarged illustration of the region of the hub 30 in FIG. 2.

One can readily see that the set-back region 33 on the upper surface 32 of the arms 31 of the hub 30 is rounded off. In a preferred embodiment, chamfering is effected in such a way that the upper surfaces 32 of the arms 31 fall away at an angle of between 1° and 10°, preferably at an angle of 2° to 4°, in the direction from the casing 13 to the central area around the drive spindle 11.

This angle does not have to be constant as is particularly apparent in FIG. 2.

For the purposes of comprehension, it is additionally mentioned that the embodiment in accordance with the invention is particularly suitable for a discontinuous hanging pendulum centrifuge as proves to be advantageous here for a sugar centrifuge. This means that the drive spindle together with the centrifuge drum 10 including the base 15, the hub 30 and the casing 13 is suspended in pendulum fashion. By contrast, the scraper 20 comprising the scraper bar 21 and the peeling knife 22 is not suspended therewith. This means that relative movement between the centrifuge drum 10 and the scraper 20 is possible.

However, this relative movement is fully allowed for by the set-back region 33 on the upper surface 32 of the arms 31 so that here, the lowest region of the scraper 20 can move through a few degrees in the course of a relative swinging movement or pendulum motion of the centrifuge drum 10 without the scraper 20 colliding or coming into engagement with a mechanical element of the centrifuge drum 10.

Figure 3:
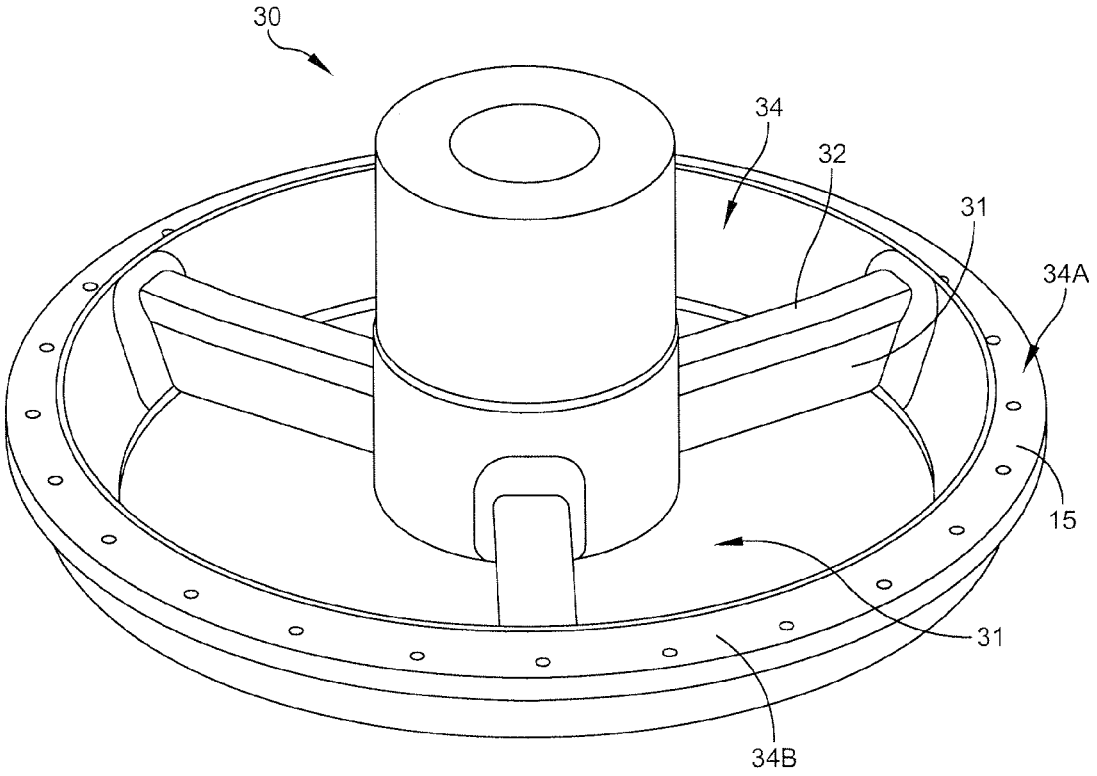
FIG. 3 a perspective illustration of the hub depicted in FIG. 2.

A perspective illustration of the hub 30 depicted in FIG. 2 is illustrated in FIG. 3. One can see that, centrally around the (not illustrated) drive spindle 11, there is provided an inner region of the hub 30 from which there project outwardly three arms 31 that are located at an angle of 120° relative to each other.

The three arms 31 merge outwardly into a ring-like annular element 34 of the hub 30 onto which a flat base surface of the base 15 is then fixed at the peripheral upper ledge 34A that defines the flat annular rest surface 34B. The arms 31 extend radially from the central hub 30 and extend substantially orthogonal to both the central hub 30 and the ring-like annular element 34.

One can easily perceive here that this hub 30 is capable of transferring the rotary motion of the drive spindle 11 to the casing 13 of the centrifuge drum 10.

In connection therewith, no part of the arms 31 of the hub 30 projects upwardly above the (not illustrated but readily conceivable) base 15.

Figure 4:
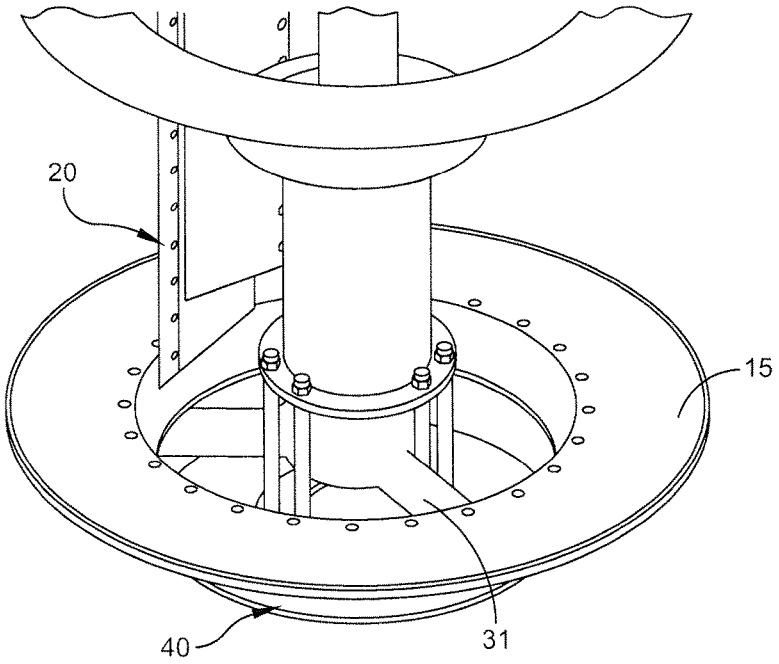
FIG. 4 a perspective illustration of the hub depicted in FIG. 3 inserted in a base of a centrifuge drum.

One can now see the interaction of the hub 30 with the base 15 in FIG. 4. The base 15 covers those areas below the casing 13 which are not occupied by the arms 31.

Below this, there is also a bottom closure 40. During the process of loading the magma and during the centrifuging process, the bottom closure 40 is arranged in such a way that the base 15 is completely closed.

During the peeling process effected by the scraper 20 in the course of which the crystallised mass 14 falls downwardly onto the base 15, the bottom closure 40 is relatively displaced such as to cause the openings 16 to form whereby the crystallised mass 14 can then accelerate through the openings 16 in the base 15.

Figure 5:
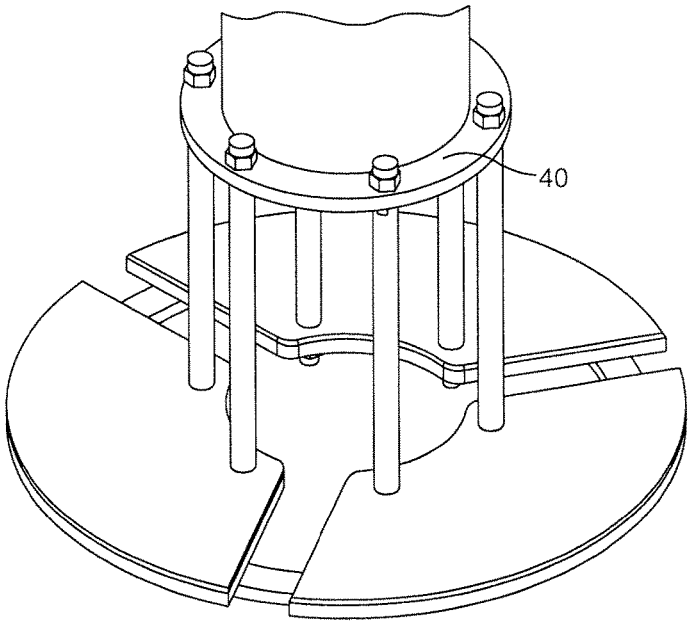
FIG. 5 a view of a base region without the hub.

This can be clearly seen in FIG. 5 wherein, for simplicity, the hub 30 and the arms 31 thereof have been omitted.

Figure 6:
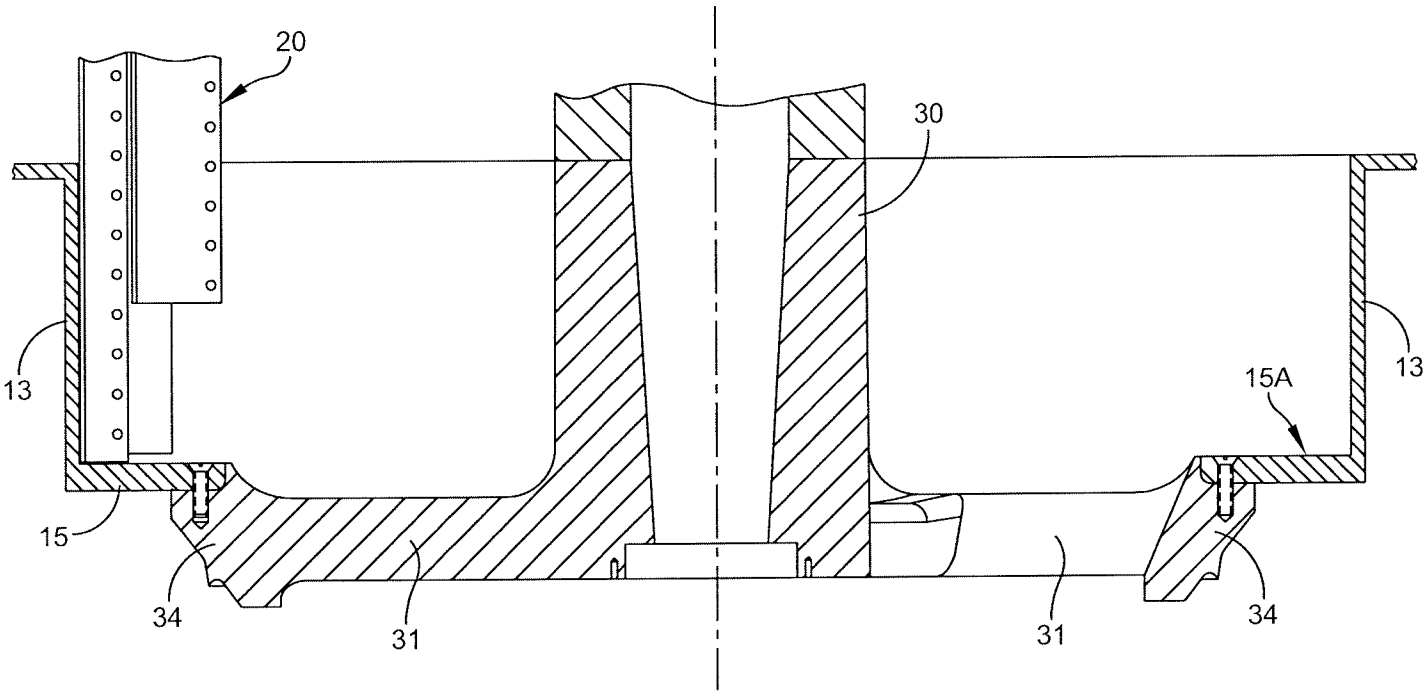
FIG. 6 illustrates the centrifuge and the relationship of the arms to the base.

FIG. 6 is a cross-sectional view that more clearly depicts the location of the arms 31 relative to the base 15 and in particular an upper surface 15A of the base 15. In FIG. 6 it can be seen that the drive mechanism does not interfere with the scraper 20 and thus the scraper 20 need not be moved vertically up and down.

Additional features in accordance with the present invention is that the ratio of the width of the arms to the height of the arms is smaller than 1:1; that the surfaces of the base and/or the hub are coated with adherence-reducing materials; that the scraper is formed in such a way that the element comprises a peeling knife that narrows in the region of its lower end; that the cross-section of the peeling knife is in the form of a wing; that the product is a crystallized mass and the base surface of the base of the casing that defines an open central area through which the crystallized mass passes; that the scraper has only pivotal movement; and that the spindle and scraper each are driven at a rotational speed and the rotational speed of the scraper is lower than the rotational speed of the spindle and drum.

LIST OF REFERENCE SYMBOLS

10 centrifuge drum
11 drive spindle of the centrifuge drum 10
12 direction of rotation of the centrifuge drum 10
13 casing
14 crystallised mass on the inner surface of the casing 13
15 base
16 openings in the base 15
20 scraper
21 scraper bar of the scrapers 20

22 element, especially a peeling knife or scraper plough of the scraper 20

30 hub

31 arms of the hub 30

32 upper surface of the arms 31

33 set-back region of the upper surface 32

40 bottom closure

What is claimed is:

1. A discontinuous centrifuge comprising:

a rotatable centrifuge drum having an axis of rotation and that includes a drive spindle, a drum casing driven by said drive spindle and a drum casing base having an upper base surface, a hub for support of the rotatable centrifuge drum from the drive spindle and including a central hub, a plurality of arms and an outer annular ring, said plurality of arms connecting respectively from the central hub to spaced apart locations at the outer annular ring, a scraper for scraping a product off an inner wall of the casing of the rotatable centrifuge drum at a scraper rotational speed, wherein the scraper comprises an element which is rotatable about an axis, which axis extends in parallel with the axis of rotation of the centrifuge drum, and wherein the element comprises a blade which extends over a height of the centrifuge drum and makes contact with the product upon rotation of the blade, and wherein the scraper is vertically stationary but rotatable, wherein each of the plurality of arms extend radially from the central hub and extend substantially orthogonal to both the central hub and the outer annular ring: wherein the outer annular ring includes a peripheral upper ledge defining a flat annular rest surface; wherein the drum casing base has a flat base surface that rests on the flat annular rest surface of the outer annular ring; wherein the plurality of arms each have an upper surface which is located below the upper base surface of the drum casing base; and wherein the plurality of arms are all disposed entirely below the drum casing base.

2. A discontinuous centrifuge in accordance with claim 1, characterized in that the hub comprises three arms, wherein the three arms are spaced from each other by a same angle.

3. A discontinuous centrifuge in accordance with claim 2, characterized in that the upper surfaces of the arms of the hub comprise a set-back region.

4. A discontinuous centrifuge in accordance with claim 1, characterized in that the ratio of the width of the arms to the height of the arms is smaller than 1:1.

5. A discontinuous centrifuge in accordance with claim 1, characterized in that surfaces of the drum casing base and/or the hub are coated with adherence-reducing materials.

6. A discontinuous centrifuge in accordance with claim 1, characterized in that the scraper is formed in such a way that the element comprises a peeling knife that narrows in the region of its lower end.

7. A discontinuous centrifuge in accordance with claim 6, characterized in that the cross section of the peeling knife is in the form of a wing.

8. A discontinuous centrifuge in accordance with claim 1, characterized in that the upper surfaces of the arms of the hub comprise a set-back region.

9. A discontinuous centrifuge in accordance with claim 8 characterized in that the ratio of the width of the arms to the height of the arms is smaller than 1:1.

10. A discontinuous centrifuge in accordance with claim 1, characterized in that surfaces of the drum casing base and/or the hub are coated with adherence-reducing materials and the scraper is formed in such a way that the element comprises a peeling knife that narrows in the region of its lower end.

11. A discontinuous centrifuge in accordance with claim 1, characterized in that the product is a crystallized mass and the upper base surface of the drum casing base of the casing defines an open central area through which the crystallized mass passes.

12. A discontinuous centrifuge in accordance with claim 1, characterized in that the scraper has only pivotal movement.

13. A discontinuous centrifuge in accordance with claim 1, characterized in that the drive spindle and scraper each are adapted to be driven at a rotational speed and the rotational speed of the scraper is lower than the rotational speed of the drive spindle and centrifuge drum.

* * * * *